United States Patent [19]

Minami

[11] Patent Number: 4,769,969

[45] Date of Patent: Sep. 13, 1988

[54] APPARATUS FOR PRODUCING SHIPPING FORMS

[75] Inventor: Isao Minami, Tokyo, Japan

[73] Assignee: Minami Seiki Co., Ltd., Tokyo, Japan

[21] Appl. No.: 19,288

[22] Filed: Feb. 26, 1987

[30] Foreign Application Priority Data

Feb. 28, 1986 [JP] Japan ..... 61-28639[U]

[51] Int. Cl.[4] ..... B65B 63/04

[52] U.S. Cl. ..... 53/117; 53/520; 53/553; 493/216; 493/248; 493/346; 493/347; 493/381; 493/921

[58] Field of Search ..... 493/223, 224, 231, 248, 493/343, 346, 347, 357, 381, 439, 340, 446, 921, 216; 53/520, 553, 117; 225/100

[56] References Cited

U.S. PATENT DOCUMENTS

| | | | |
|---|---|---|---|
| 3,286,435 | 11/1966 | Weinberger | 53/520 |
| 4,071,997 | 2/1978 | Gunther, Jr. et al. | 53/520 |
| 4,464,878 | 8/1984 | Galicz et al. | 493/216 |
| 4,520,615 | 6/1985 | Engler et al. | 493/248 |
| 4,668,212 | 5/1987 | Kotani | 225/100 |

FOREIGN PATENT DOCUMENTS

| | | | |
|---|---|---|---|
| 2380208 | 9/1978 | France | 53/553 |
| 2383872 | 10/1978 | France | 53/553 |

*Primary Examiner*—Frederick R. Schmidt
*Assistant Examiner*—Robert Showalter
*Attorney, Agent, or Firm*—David H. Semmes; Warren E. Olsen

[57] ABSTRACT

The present invention provides an apparatus for producing a shipping form characterized by a folding mechanism, a cutting off mechanism, an aligning and feeding mechanism, a form inserting mechanism and a cutting mechanism.

1 Claim, 4 Drawing Sheets

APPARATUS FOR PRODUCING SHIPPING FORMS

BACKGROUND OF THE INVENTION

1. Field of the Invention

This invention relates to shipping forms to be affixed to the shipping material, and more particularly to an apparatus for producing shipping forms capable of being printed by a laser printer.

2. Description of the Prior Art

Heretofore, the shipping form generally comprises a multiple copy-possible form as one set and the bottom paper thereof is composed as a tack sheet or paper for affixing to a shipping material. In case the shipping information and the like are described in a plurality of shipping forms, a continuous sheet form is subjected to an impact printer to print the shipping information and then to cut it one set at a time for affixing to the shipping material.

At present, since the non-impact printer or the laser printer which enables a kanji (Chinese character) printing and high velocity printing has been developed and the treatment capacity thereof is also excellent, many non-impact printers or laser printers have been used for a large amount of printing treatments. By this, the demand for using it for the printing of information on the shipping form has been increased.

However, since the non-impact printer or the laser printer can print only one sheet form, it is impossible to use it for the conventional copy form. Accordingly, there exists a problem in that it is restricted to only one sheet form and also it is difficult to use the tack sheet or paper for affixing.

OBJECT OF THE INVENTION

The object of this invention is to dissolve the above problems and to produce an affixing form which is possible to be printed with a non-impact printer or a laser printer.

SUMMARY OF THE INVENTION

This invention provides an apparatus for producing a shipping form, the apparatus comprising a folding mechanism wherein a continuous form composed of a series of single forms divided by lateral perforated seams and longitudinal perforated seams is folded at said longitudinal performated seams and laterally folded plurally, a cutting off mechanism wherein the continuous form is cut off into single forms one by one at said lateral perforated seams by means of two sets of rolls of which the feeding velocities are different between an inlet side and an outlet side of the folded continuous form, an aligning and feeding mechanism wherein said single forms are aligned and fed sheet by sheet at predetermined intervals, a mechanism for inserting a single form wherein a tack film having one surface coated with a pressure sensitive adhesive and a release sheet to be releasably affixed to said adhesive-coated surface are peeled off in advance and separately transported, and said tack film and said release sheet are connected with said single forms interposed therebetween at fixed intervals, and a cutting mechanism wherein said tack film and said release sheet with said single forms inserted at fixed intervals are cut transversely. It is possible to produce, by said apparatus, shipping forms which can be printed with a non-impact printer or a laser printer.

DETAILED DESCRIPTION OF THE INVENTION

Figure 1:
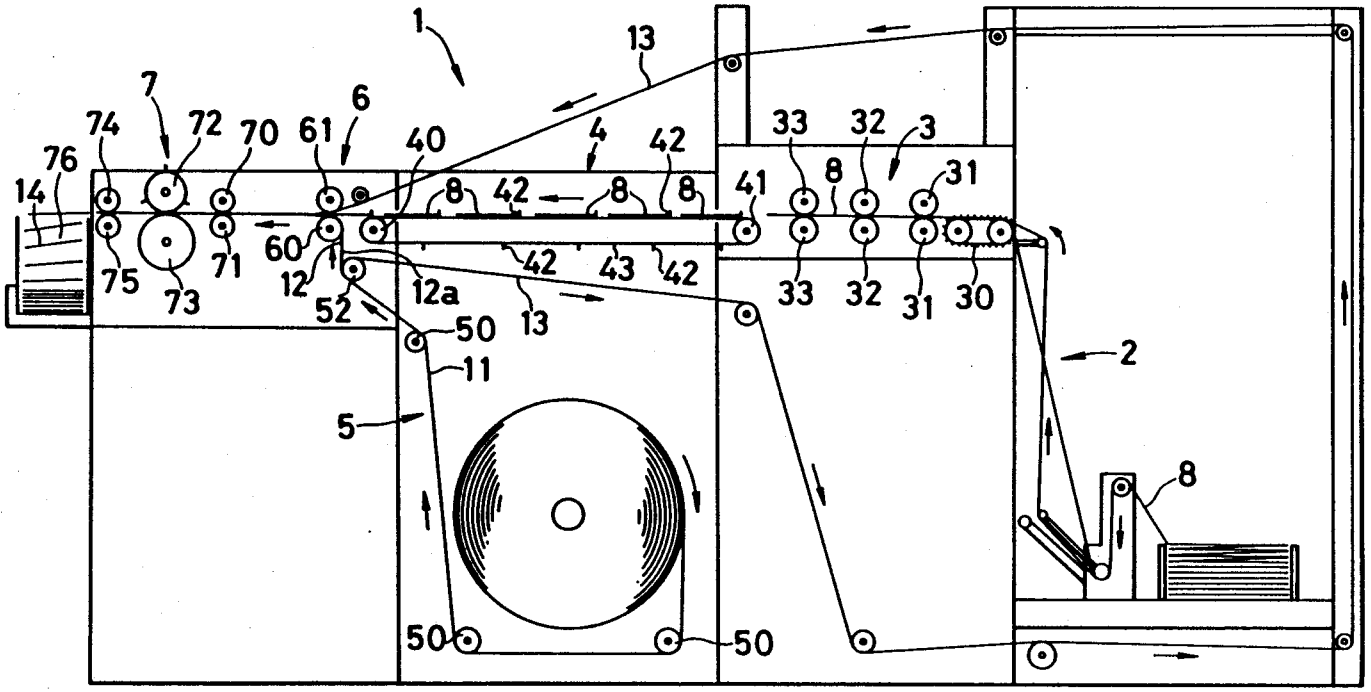
FIG. 1 is a schematic view showing one embodiment of apparatus for producing a shipping form according to this invention.
Figure 2:
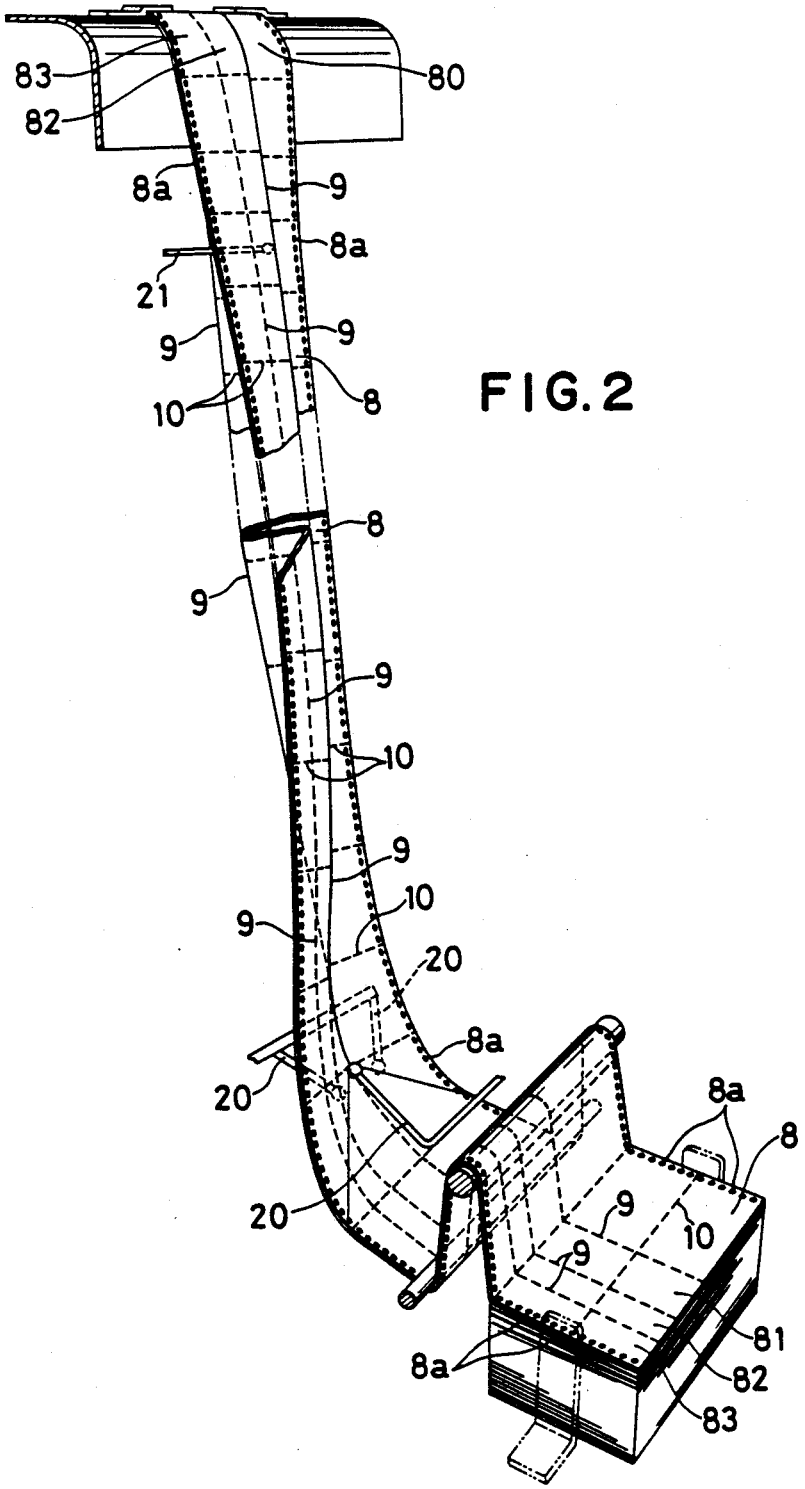
FIG. 2 is a fragmentary perspective view showing a folding mechanism in one embodiment.

This invention will be described in detail in connection with embodiments shown in FIGS. 1 to 5.

An apparatus for producing a shipping form is indicated at 1, the apparatus 1 comprising a folding mechanism 2 for folding a single continuous form in a form of Z along longitudinal seams thereof, a cutting off mechanism 3 for cutting off single forms from the continuous form one by one from lateral seams with the difference of feed velocities between an inlet side and an outlet side of the continuous form, an aligning and feeding mechanism 4 for transporting cut single forms while adjusting feed spacings, a tack film and release sheet transporting mechanism 5 for peeling a tack film apart from a release sheet to separately transport the same, a form inserting mechanism 6 for feeding a cut single form folded in a form of Z at fixed intervals between the tack film and the release sheet when the relase sheet is again affixed to the adhered surface of the tack film, and a cutting mechanism 7 for cutting transversely the tack film and release sheet in the central portion between the inserted single forms.

Figure 3:
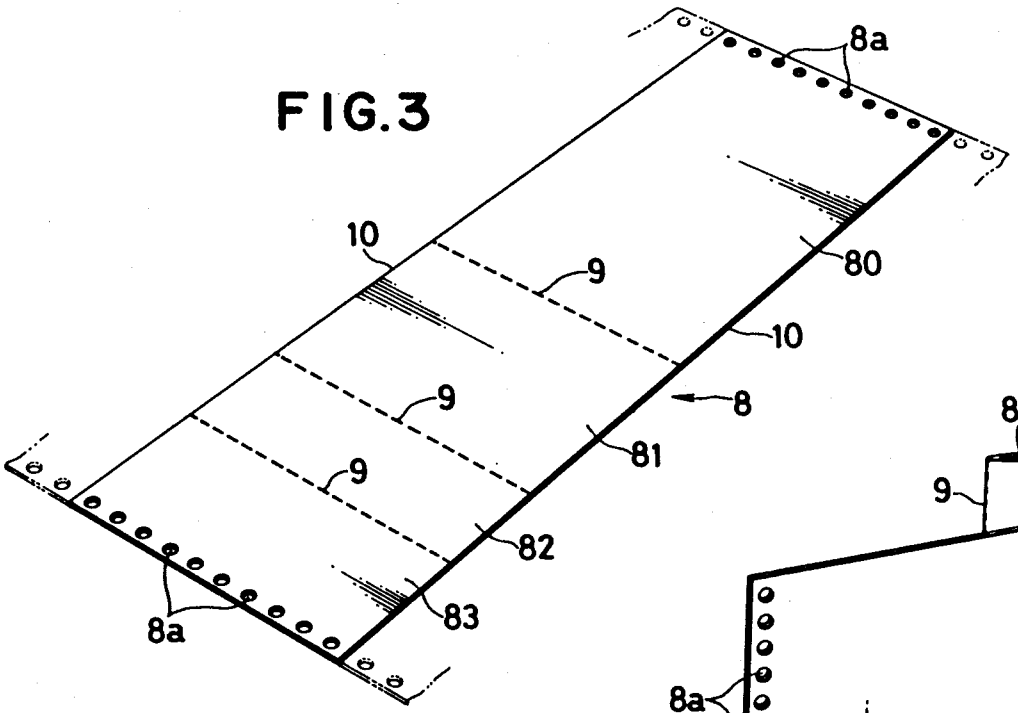
FIG. 3 is a fragmentary perspective view showing a continuous form.
Figure 4:
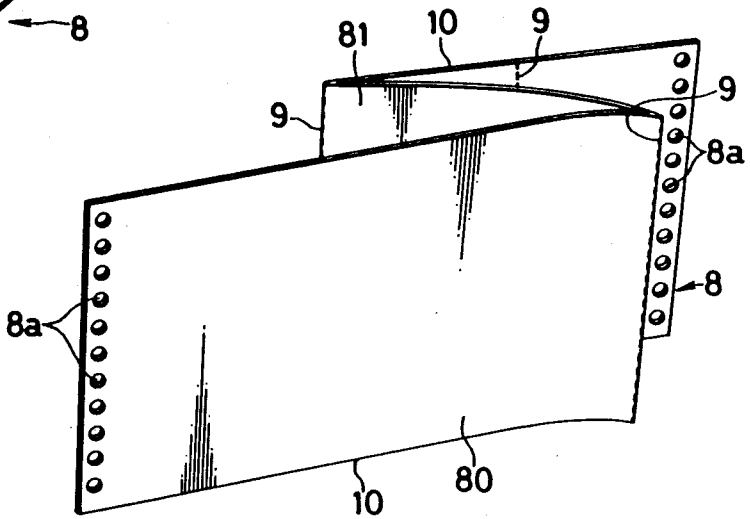
FIG. 4 is a perspective view showing a folded continuous form.
Figure 5:
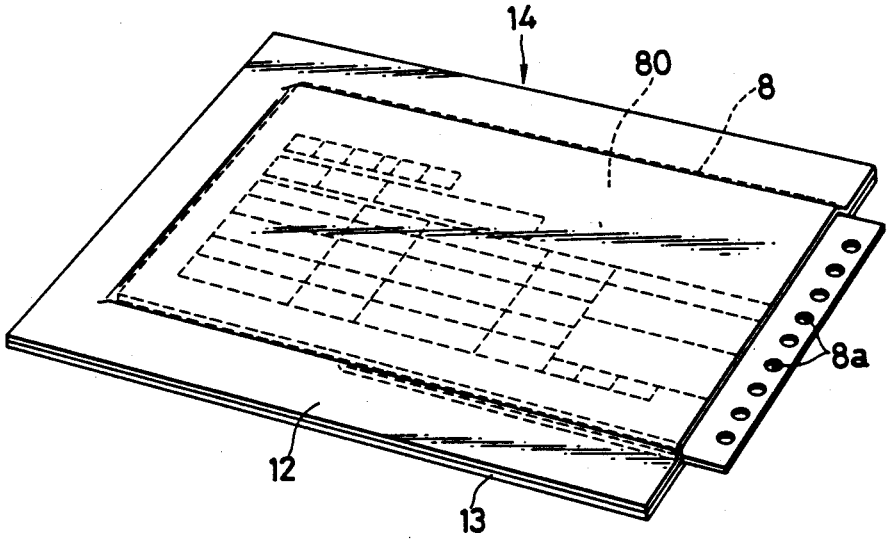
FIG. 5 is a perspective view showing a finished shipping form.

A continuous form 8 includes a single form in which four forms are laterally connected through longitudinal perforated seams 9 as shown in FIG. 3, the single form being vertically defined through a lateral perforated seam 10. Single forms divided by the longitudinal perforated seams 9 are respectively, for example, a form to be affixed to a material 80, a carrier agent form 81, a receipt 82 and a paying-in slip or form 83.

The folding mechanism 2 functions to draw out the continuous form 8 folded in a staggered fashion and stacked, guide bars 20 are applied to the longitudinal perforated seams 9 from both inside and outside, apply a relatively upwardly located guide bar 21 is applied to the longitudinal sewing seams 9 from the outside, and the form is folded in a form of Z so that the carrier agent slip 81, receipt 82 and paying-in slip 83 are positioned on the outside of the form to be affixed to a material 80.

The cutting off mechanism 3 is composed, as shown in FIG. 1, of a sprocket 30 to deliver a marginal punch 8*a* through the continuous form 8, slit rollers 31 for cutting off the marginal punch side a predetermined width as necessary, first feed rollers 32 which are rotated with their feed velocities being synchronized with the feed caused by the sprocket 30 and positioned at the inlet side of the continuous form, and second feed rollers 33 which are driven separately from the first feed rollers, faster in the feed velocities than those of the first feed rollers and positioned at the outlet side of the continuous form. Since the feed velocity of the first feed rollers 32 is different from that of the second feed roller 33, tension is applied to the continuous form, which is cut one by one at the lateral perforated seam 10.

The aligning and feeding mechanism 4 is composed of a belt 43 having push pins 42 mounted at intervals somewhat wider than the longitudinal length of the single form between a driving roller 40 and a driven roller 41, as shown in FIG. 1, which mechanism aligns and transports the single forms 8 sheet by sheet at fixed intervals from said cutting off mechanism 3.

The tack film and release sheet transporting mechanism 5 for separating a release sheet 13 from a pressure sensitive adhesive coated surface 12*a* of a tack film 12 to transport the same is composed of guide rollers 50 for transporting a tack film 11 with a release sheet, a separating roller 52 for separating the tack film from the release sheet, and a guide roller 52 for guiding the transport of the release sheet, whereby the tack film 12 with the once separated adhesive coated surface 12*a* placed on the top and a release sheet 13 are fed into a form inserting mechanism which will be described later.

The form inserting mechanism 6 is composed of a pair of press rollers 60 and 61. The upper portion of the single form 8 from the aligning and feeding mechanism 4, i.e., the form to be affixed to the material 80 is pasted to the adhesive coated surface 12*a* of the tack film 12 fed from the underside of the press roller 60, during which the release sheet 13 being fed from the upperside of the press roller 61 and the tack film 12 are again connected.

The cutting mechanism 7 is composed of feed-in rollers 70, 71, a knife edge roller 72 and a receiving roller 73, and feed-out rollers 74, 75, whereby the tack film 12 embracing the single forms 8 at fixed intervals from the form inserting mechanism 6 and the release sheet 13 are cut in the central portion in a gap portion between the single forms 8. Individual shipping forms 14 are finally formed through this cutting mechanism 7 and successively stacked within a stacker 76.

EFFECTS OF THE INVENTION

As described above, according to this invention, the single form placed between the tack film and the release sheet is folded and cut in advance, and the single form after being cut is embraced between the tack film and the release sheet. Therefore, a printing of information can be carried out with a non-impact printer or a laser printer before folding and a large amount of printing treatments in the production of shipping forms becomes possible, thus providing a shipping forms which can be printed with a non-impact printer or a laser printer and can be affixed to a parcel. Furthermore, since the non-impact printer or the laser printer can be used, shipping management information such as bar codes may be printed to render shipping business rapid and simple, thus providing practically excellent effects.

What is claimed is:

1. An apparatus for producing shipping forms from continuous webs and having a frame mounting for supporting a web of shipping forms and a web of adhesive and release sheets, comprising:

(a) a folding mechanism wherein a continuous web of shipping forms composed of a series of single forms divided by lateral perforated seams and longitudinal perforated seams is folded in the form of Z along said longitudinal perforated seams;

(b) a cutting off mechanism wherein the continuous web of shipping forms is cut at the margins and single folded forms are cut off one by one at said lateral perforated seams by means of two sets of rollers having feed velocities which are different between an inlet side and an outlet side of the folded form;

(c) an aligning and feeding mechanism wherein said single folded forms are aligned and fed sheet by sheet at fixed intervals;

(d) a mechanism for inserting a single folded shipping form including:

(i) a peeling off roller wherein a tack film having one surface coated with a pressure sensitive adhesive and a release sheet to be releasably affixed to said adhesive-coated surface formed as a web are peeled off from each other and separately transported, and (ii) a folded form-insert, having a pair of connecting rollers and an aligning belt wherein said single folded forms are fed between said connecting rollers, such that said tack film and said release sheet are reconnected as a web and enclose said single folded forms interposed therebetween at fixed intervals; and (e) a cutting mechanism transversely engaging said tack film and release sheet web with said single forms inserted therein at fixed intervals so as to cut in the gap of the web between single forms, such that single forms are separated from said web.

* * * * *